United States Patent [19]

Oberste-Beulmann et al.

[11] 4,166,652

[45] Sep. 4, 1979

[54] MINING MACHINE, PARTICULARLY FOR THE WORKING OF LOW MINE SEAMS

[75] Inventors: Klaus Oberste-Beulmann, Sprockhovel; Herbert Schupphaus, Bochum; Karl-Heinz Borowski, Bochum; Willy Lanfermann, Bochum; Friedhelm Henrich, Bochum, all of Fed. Rep. of Germany

[73] Assignee: Gebr. Eickhoff Maschinenfabrik und Eisengiesserei m.b.H., Bochum, Fed. Rep. of Germany

[21] Appl. No.: 922,951

[22] Filed: Jul. 10, 1978

[30] Foreign Application Priority Data

Jul. 16, 1977 [DE] Fed. Rep. of Germany ..... 2732275

[51] Int. Cl.[2] ..... E21C 35/12

[52] U.S. Cl. ..... 299/43; 299/71

[58] Field of Search ..... 299/43–48, 299/34

[56] References Cited

U.S. PATENT DOCUMENTS

| | | | |
|---|---|---|---|
| 3,753,595 | 8/1973 | Lanfermann | 299/43 |
| 4,067,620 | 1/1978 | Lanfermann | 299/43 |

FOREIGN PATENT DOCUMENTS

| | | | |
|---|---|---|---|
| 1272255 | 7/1968 | Fed. Rep. of Germany | 299/43 |
| 2224478 | 4/1973 | Fed. Rep. of Germany | 299/43 |
| 2215680 | 10/1973 | Fed. Rep. of Germany | 299/43 |
| 2508956 | 9/1976 | Fed. Rep. of Germany | 299/43 |

*Primary Examiner*—Ernest R. Purser

*Attorney, Agent, or Firm*—Thomas H. Murray; Clifford A. Poff

[57] ABSTRACT

A drum cutter-loader machine includes discrete units joined together by tie bolts extending transversely to the direction of advancing movement along a face conveyor. The units in succession from the stow side to the working side include a gantry casing supporting winch drive motors and straddling the face conveyor, a transmission box, a winch casing and casing carrying actuators coupled to arms carried by pivots at opposite ends of the winch casing. The arms carry cutter drums driven by motors supported by the arms. A toothed rack at the working face side is engaged by drive wheels driven through gearing in the winch casing and transmission box by the winch motors. The gantry casing is supported at the stow side through runners that engage a guide rail. In one embodiment, the machine is supported by rollers at the working face side on the toothed rack. In a further embodiment, the machine is supported by rollers at the working face side on a machine track.

15 Claims, 6 Drawing Figures

1
2
3
4
7
8
9
10
11
12
13
31
33
34
35
36
40
41
43
44
50
52

10
9
28
26
25
27
24
16
19
14
17
18
33
15

13
18
17
19
16
24
27
26
28
25
29

MINING MACHINE, PARTICULARLY FOR THE WORKING OF LOW MINE SEAMS

BACKGROUND OF THE INVENTION

The invention concerns a drum cutter-loader machine for working mine seams, especially thin mine seams while located close to the face conveyor in the winning zone; the machine consisting of discrete units that include a gantry-like casing which overlies the face conveyor and engages a guide bar which extends over the machine's travel path at the stow side, the machine also being provided with vertically-adjustable drum cutter support arms which lie somewhat above the face conveyor's face-side wall.

German Pat. Specification No. 2 113 399 discloses drum cutter-loaders of this kind which are located within the winning zone. Such machines are supported at the bottom of the trench by means of a runner adapted to be operated by means of an adjustable reducing valve, and move on their own track which is located near the face-side wall of the face conveyor and engage, by way of an extension of the casing, with a guide bar for the face conveyor located on the stow side. The drive wheel sprocket and two chain-reversing sprockets of the machine winch are housed within the extension of the casing which straddles across the face conveyor. These sprockets are located above the side wall at the stow side in the plane of the chain which is stretched out over the length of the longwall face.

German Pat. Specification No. 1 060 921 discloses a drum cutter-loader having a pivot at both ends which overhangs the machine frame. The pivot is parallel to the floor and perpendicular to the direction of machine movement. A support arm is attached to each pivot and moved by means of a pressure cylinder, each such arm carrying a cutter drum. The arm having on the stow side—i.e. on the arm side remote from the cutter drum—a driving motor which is mounted parallel to the pivot and which bears on the said pivot at the end remote from the support arm.

SUMMARY OF THE INVENTION

It is an object of the invention to provide a drum cutter loader machine with a transmission box which lies above the machine track on its working face side, a winch casing flange mounted on the transmission box on the working face side, a cutter support arm mounted on each of the end faces, each arm being fitted with a drive motor pivotably mounted together with the support arm on a pivot attached to the winch casing, the invention being further characterized by the fact that at the stow side the transmission box carries a gantry casing which straddles the face conveyor and in which there is mounted winch-driving motors with their axes aligned transversely to the travel direction of the machine, the said motors being installed in bores of corresponding diameter in the winch casing.

In addition to its low height, a drum cutter loader machine with this form of construction, in which there are two mutually independent winches, has an exceptionally short overall length and a center of gravity which lies directly over the machine's travel track on the face side. In addition, because the drive motors for the two drum cutters and the winches are located outside the actual casing, the machine made in accordance with the invention can readily be repaired and is therefore suitable for use in thin seams.

A drum cutter-loader so constructed can operate at the bottom of a trench without a runner for its frame and it can be carried just by the face-side track and bear on and be guided by the guide bar at the stow side of the face conveyor and can therefore be moved with the machine frame extending freely into the winning zone. Advantageously, to reduce the overall height of the machine frame so that the rear cutter drum can detach and load the floor material left below the front cutter drum, it is advisable to attach the cylinders which actuate the cutter drum support arms to an extension of the drive-motor's casing which is connected to the support arms, and to house the said cylinders in their own casing which is detachably fastened to the face-side wall of the winch casing.

Conveniently, the transmission box has driving wheels, each driven by a separate motor. The driving wheels engage a toothed rack which extends below the transmission box and which may, if required, form the face-side track for the machine. The driving wheels are connected, by way of intermediate wheels mounted in the transmission box, to the output journals of reduction gearing mounted inside the winch. The force for advancing the machine is therefore applied in the plane which contains the machine's center of gravity, thus reducing the load on the guide to the stow side. Advantageously, the rollers which support the machine on the toothed rack are arranged coaxially with the driving wheels. These rollers are mounted so as to rotate independently of the driving wheels. Thus the driving wheels and the teeth of the rack always mesh satisfactorily with each other and this helps to obviate sliding movements between the rollers and the rack serving as the track.

Alternatively, the machine can bear on the face side, not on the rack but on a special track located between the mine face and the rack. The track, which also serves as the striking ramp for the face conveyor, improves the stability of the machine and relieves the vertical forces which act on the guide bar at the stow side.

Advantageously, too, the support arm pivot is mounted in an extension of a plate releasably mounted on an end face of the winch casing. This feature facilitates replacement, in the event of damage, of the heavily stressed extension which has to carry, together with the support arm pivot, the cutting unit comprising the cutter drum, the support arm, and the drive motor.

To ensure that the drum cutter-loader machine remains in its normal horizontal position and does not tilt toward the floor at the bottom of the trench when repair work is being carried out (repairs must be carried out with the gantry casing removed), the winch casing is provided, near its longitudinal center, with a vertical cylindrical bore to receive a piston by means of which the machine frame is, if required, supported upon the mine floor. The piston is extended only during repair work and maintains the machine frame in its normal position.

Conveniently, the gantry casing straddling the face conveyor receives the actuating means and the elements for controlling the drum cutter loader machine. Also, the gantry casing can be adapted to be pushed on to the ends of the support arm pivots. These features make it easier to attend to faults in the electrical part of the machine and facilitates assembly of the machine underground.

According to another feature, the transmission box, winch casing, the casing for the actuating cylinders and the gantry casing are clamped together by means of tie bolts extending transversely to the direction of movement of the machine. In this way, the discrete units which make up the complete machine can be combined to form a compact portable unit which can be used without a machine frame and which therefore has an exceptionally low overall height.

Advantageously, too, the gantry casing is connected by way of vertical actuating cylinders to its guide runners which extend around the guide bar. These cylinders can then pivot the machine around its longitudinal axis and the two cutter drums can always be moved into a position parallel to the floor. So that the pivoting movement does not disturb the meshing relation between the driving wheels and the toothed rack, the driving wheels of the winch casing have curved teeth and mesh with the toothed rack with a lateral clearance sufficient for adjustment of the machine. Also, its rollers have a spherical peripheral surface for the same reason.

Two embodiments of the invention are shown in the accompanying drawings, in which.

Figure 1:
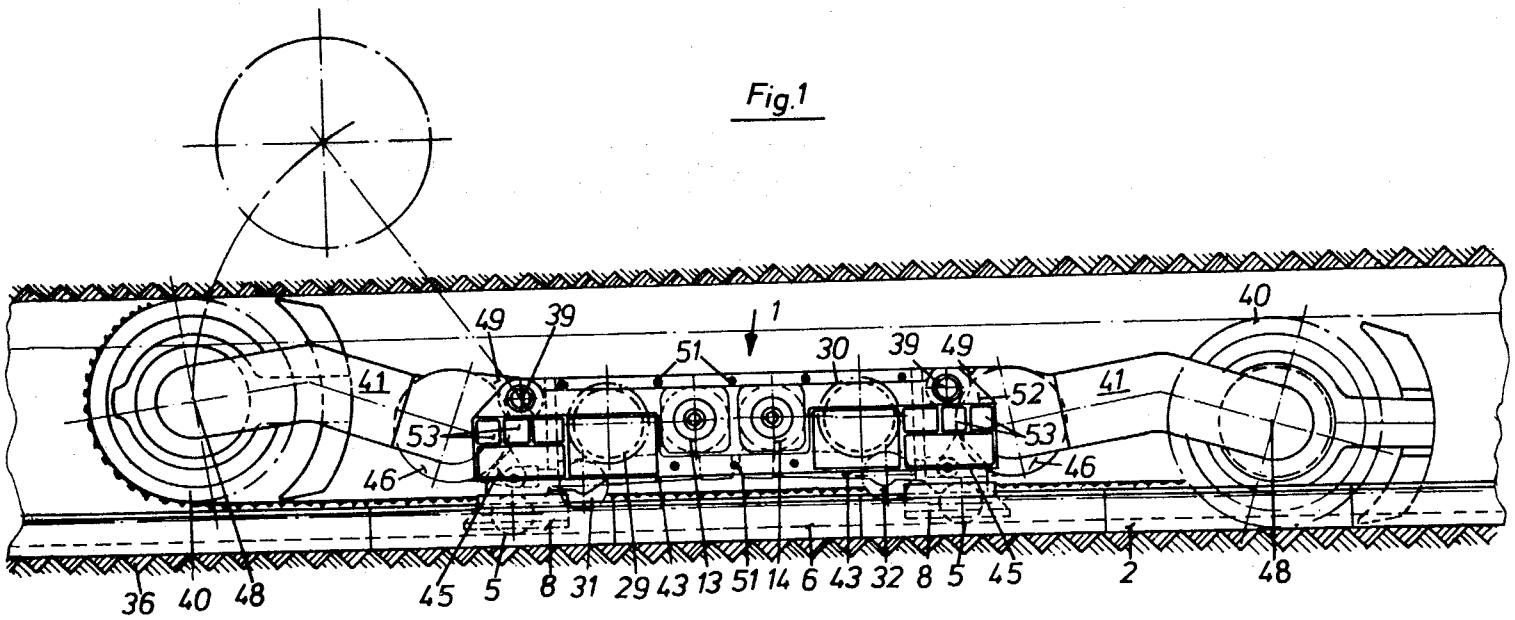
FIG. 1 is a side elevational view of a drum cutter-loader machine according to one embodiment of the present invention.
Figure 2:
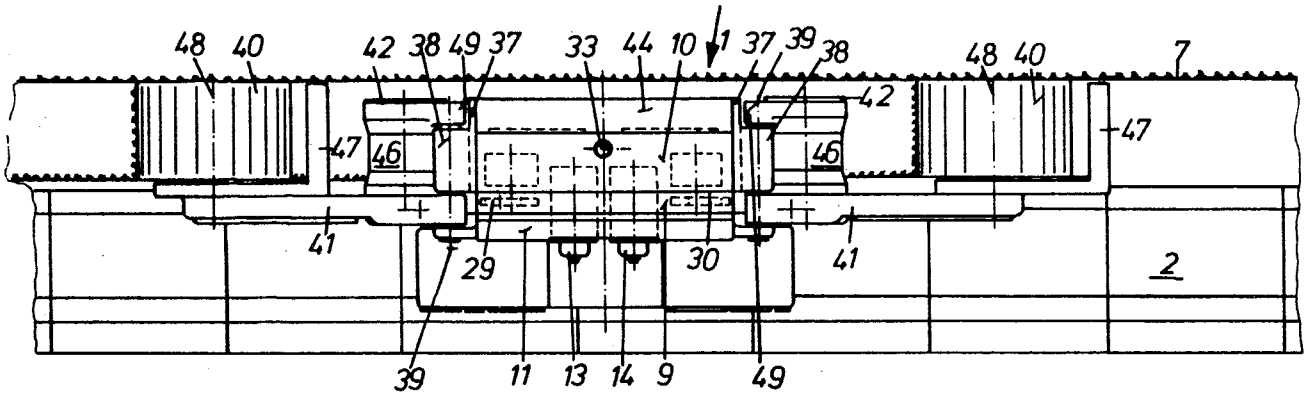
FIG. 2 is a plan view of the machine shown in FIG. 1.
Figure 3:
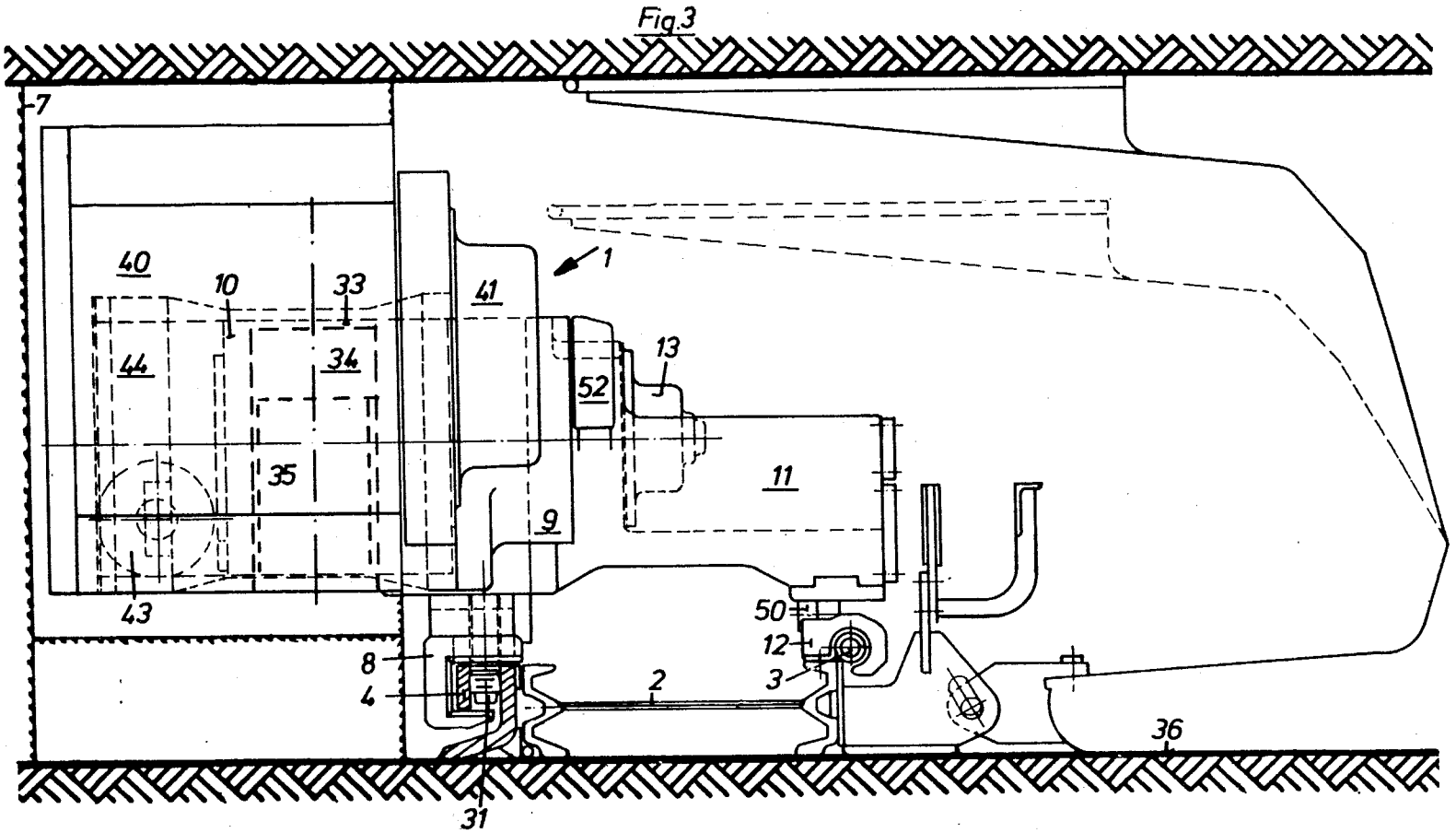
FIG. 3 is an end view of the machine shown in FIG. 1.

A drum cutter-loader machine 1 is shown in FIGS. 1–3 stationed partly over a face conveyor 2 which includes a tubular guide bar 3 along the stow side thereof. The machine 1 is supported by the guide bar while traveling along the face conveyor. At the working face side, the machine 1 is carried on a toothed rack 4 which is attached to the side wall of the conveyor 2 (FIG. 3). In the embodiment shown in FIGS. 1–5, the weight of the machine is supported through rollers (not shown) engaging the rack 4; whereas, in the embodiment shown in FIG. 6, the weight of the machine is supported through rollers 5 engaging a special track 6 which is located between mine face 7 and rack 4 at the working face side. The track 6 forms the ramp for the conveyor 2. In both embodiments, the rollers 5 are mounted in or on a runner 8 which engages the bottom of the rack 4 and maintains the machine 1 at the working face side engaged with the track 6 or on the rack 4.

Figure 4:
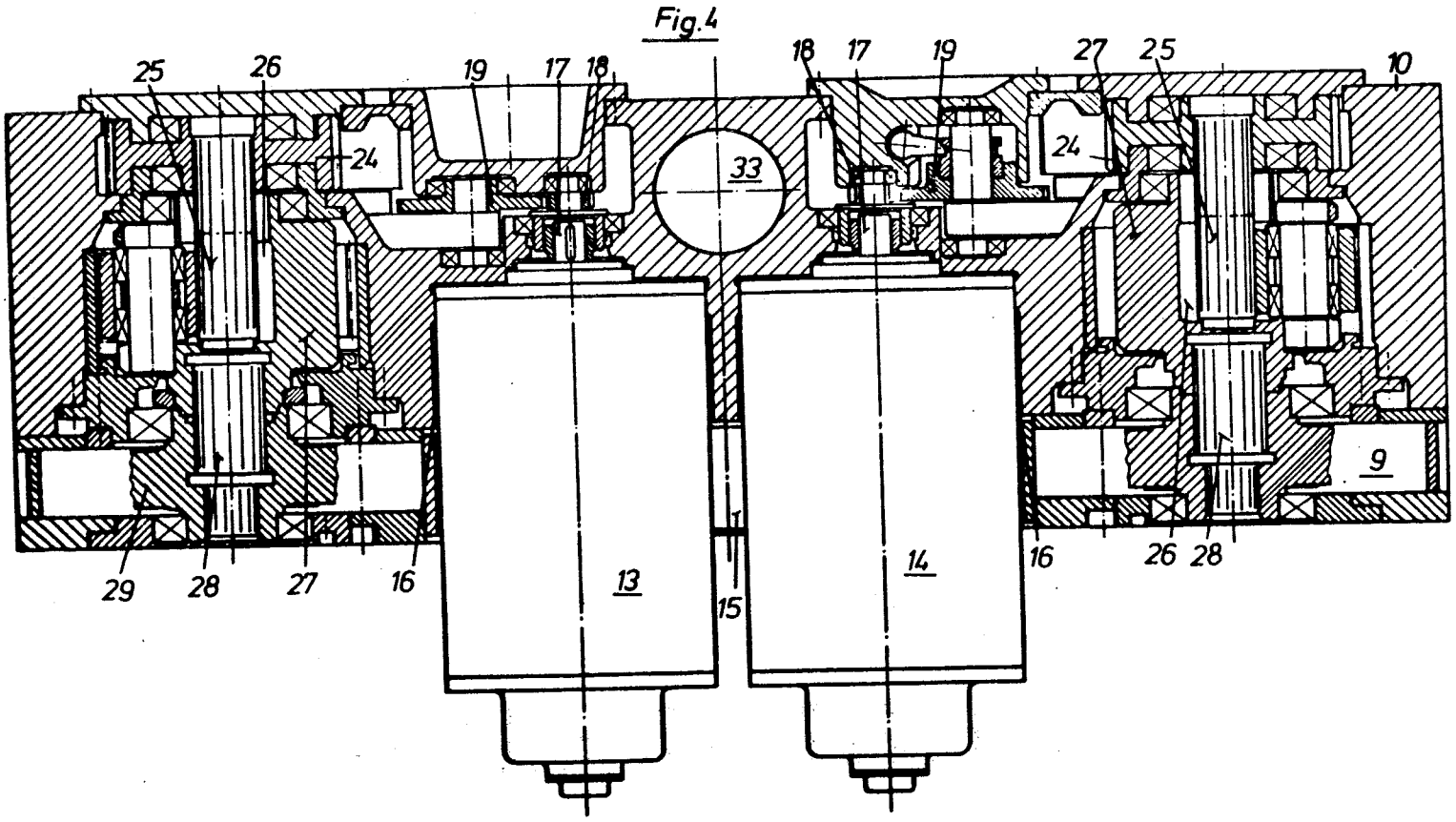
FIG. 4 is an enlarged sectional plan view showing the details of the winch and the two driving motors.
Figure 5:
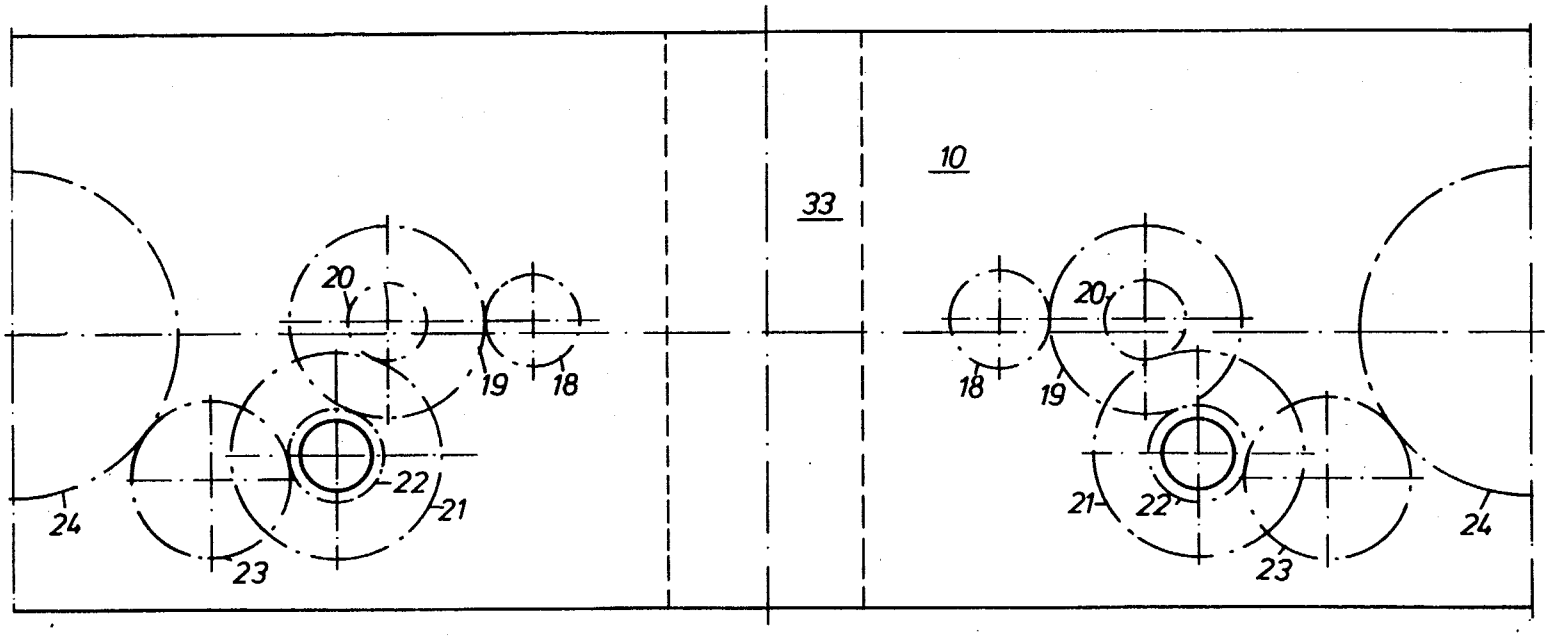
FIG. 5 is a diagrammatic elevational view of the winch reduction gearing.
Figure 6:
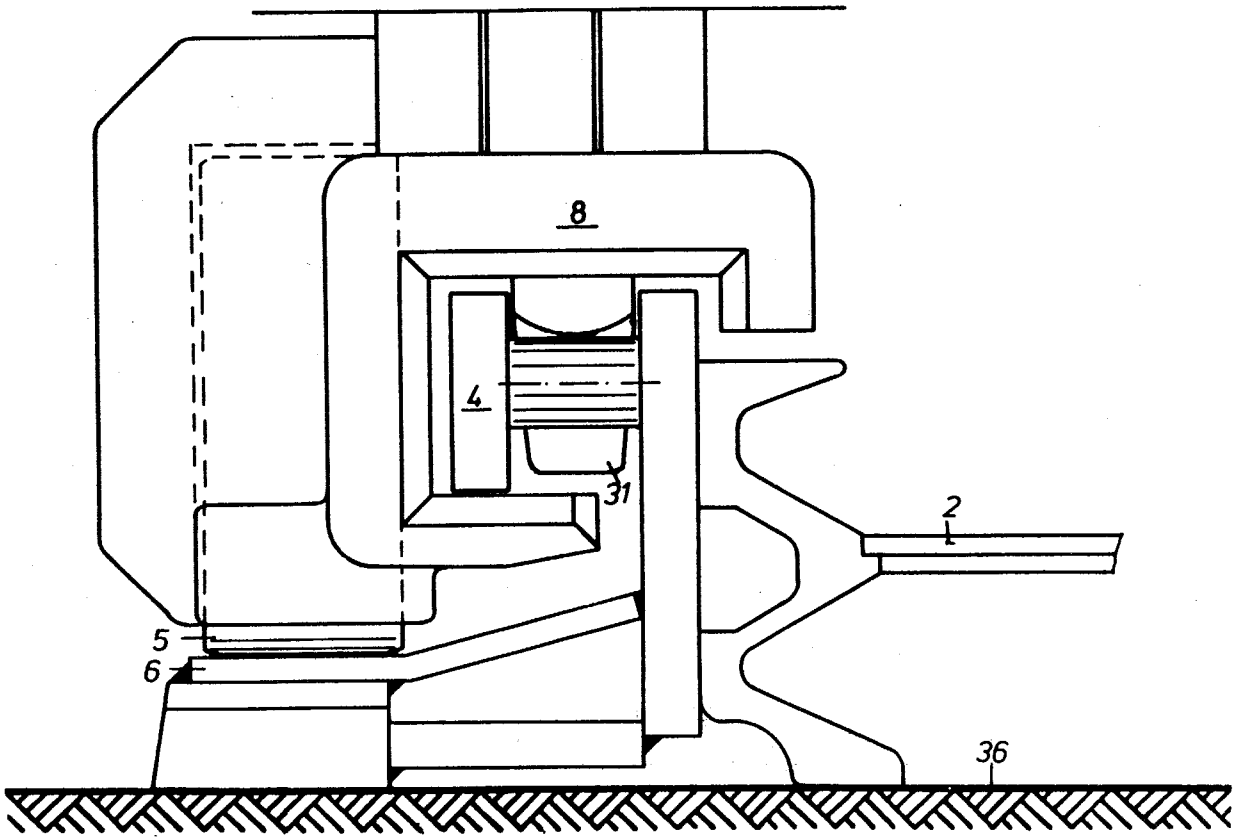
FIG. 6 is an enlarged end view of a second embodiment of the drum cutter-loader machine.

As shown in FIG. 2, the machine 1 includes a transmission box 9 located above the track 6. A winch casing 10 is flange-connected to the transmission box 9 on the working face side thereof. A gantry casing 11 is attached to the transmission box 9 at the stow side thereof. The gantry casing 11 extends over the width of the face conveyor 2 and guide runners 12 (FIG. 3) engage around the tubular guide bar 3. The gantry casing 11 carries two winch drive motors 13 and 14 which serve to advance the machine 1 along the face conveyor. These drive motors project from the gantry casing 11 towards the winch casing 10 and extend through an aperture 15 in the transmission box 9 into bores 16 in winch casing 10. The drive motors 13 and 14 are centered in these bores which have diameters corresponding to the diameters of the motors. As shown in FIGS. 4 and 5, the winch drive motors 13 and 14 each has a drive output journal 17 carrying a pinion 18 operatively coupled to a pinion 19 which, together with gears 20–24, serve as reduction gearing to drive a sun wheel 25 of a planetary transmission 26 (FIG. 5). The rotation of both planetary transmissions 26 is transmitted by way of a satellite carrier 27 and a shaft 28 to two intermediate wheels 29 and 30 located within the transmission box 9. The gear teeth of the wheel 30 mesh with the gear teeth of driving wheels 31 and 32 in engagement with the toothed rack 4 (FIG. 4). A piston 34 (FIG. 3) is adapted for displacement by pressurized hydraulic fluid within a vertical bore 33 (FIG. 4) located in the winch casing 10 between the two drive output journals 17. When the gantry casing 11 is removed together with the winch drive motors 13 and 14 for repair work, support for the machine 1 is provided by way of a piston rod 35 extending from piston 34 to the mine floor 36 (FIG. 3).

As shown in FIG. 2, plates 37 are releasably mounted onto the two end faces of the winch casing 10. Each plate 37 has an extension 38 carrying a horizontal support arm pivot 39 which extends transversely to the direction of movement of the machine. A cutting unit comprising a cutter drum 40, support arm 41 and drive motor 42 is mounted on each pivot 39. The cutting units are vertically adjustable through pivotal movements of support arm 41 about pivots 39 by means of individual piston and cylinder assemblies 43. The piston and cylinder assemblies 43 are housed in a special casing 44 attached to the face-side wall of the winch casing 10. The rod ends of the piston and cylinder assemblies 43 are individually connected to an extension 45 (FIG. 1) of a motor casing 46 of a cutting unit. In each cutting unit, the motor casing is located behind the cutter drum 40 and in front of the winch end-face where it is releasably connected to arm 41 and receives the motor 42 which is flame-proof. In addition to arm 41, motor casing 46 is mounted by means of an extension 49 on pivot 39. Also, each of the two cutting units has a clearing shield or plate which is adapted to pivot around the cutter drum axis 48 into a position to cover the peripheral region of the cutter drum 40 which is remote from the mineral.

As FIG. 3 shows, the machine 1 is supported solely by the tubular guide bar 3 on the stow side and by the rack 4 on the face side. Some of the frame of the machine extending freely into the winning zone as far as the working face. Actuating cylinders 50 provide a connection between the runners 12 and the gantry casing 11. By actuating cylinders 50, the machine 1 can be pivoted around the track 6 which is on the face side, or around that surface of rack 4 serving as track for the machine, and always be so aligned that its two cutter drums make a cut parallel to the floor 36. So that this adjusting movement does not impair meshing of the two driving wheels 31 and 32 with the toothed rack 4 (FIG. 1), the drive wheels have curved teeth and have adequate lateral clearance in the rack 4. For the same reason, the rollers 5 whereby the machine runs on the rack 4 or track 6 have a spherical peripheral surface and therefore have an adequate bearing surface on rack 4 or track 6 in all positions of the machine.

As shown in FIG. 2, the transmission box 9, winch casing 10, gantry casing 11 and the casing 44 for the cylinders 43 are rigidly interconnected by common tie bolts 51 extending transversely to the direction of machine movement to form a unitized self-supporting frame which rests on the face side of the conveyor 2 by way of the rollers 5 (FIGS. 1 and 6) of the runners 8 attached to the transmission box 9, and which rests on the stow side of the conveyor 2 via runners 12 on the tubular guide-bar 3. To facilitate assembly, the two ends of the gantry casing 11 are provided with an extension 52 whereby it can be pushed on to the pivot 39. In addition to the two winch-driving motors 13, 14, the gantry casing 11 houses the controls for the machine 1, the entering lines and the operating elements 53 for controlling the machine. The operating elements 53 are provided in duplicate, i.e., at the left-hand end and at the right-hand end of the gantry casing 11.

We claim as our invention:

1. A drum cutter-loader machine for working a mine seam particularly a thin mine seam while moving along the winning zone thereof adjacent the working face side of a face conveyor which includes a machine support track along the working face side and a guide bar along the stow side, said drum cutter-loader machine including the combination of:

a gantry casing supported by said guide bar while straddling said face conveyor, winch drive motors carried by said gantry casing with the rotational axes of the motors extending transversely to said face conveyor, a transmission box joined to the working face side of said gantry casing to extend above said machine support track, said transmission box having openings to receive said winch drive motors, rollers engaging said machine track to support said transmission box at the working face side of said face conveyor, a winch casing joined to the working face side of said transmission box, drum cutter support arms extending from opposite end faces of said transmission box substantially above the conveyor wall at the working face side of said face conveyor for vertical displacement, a pivot to mount each of said drum cutter support arms to said winch casing, a cutter drum on the extended end of each of said drum cutter support arms for working the mine seam, and drum drive motors each carried by one of said drum cutter support arms between the cutter drum mounted thereon and said winch casing.

2. The drum cutter-loader machine according to claim 1 wherein said gantry casing and said transmission box and said winch casing define a machine frame supported only by said machine track and said guide bar while extending freely into said winning zone.

3. The drum cutter-loader machine according to claim 1 further including piston and cylinder assemblies for pivotally positioning said drum cutter support arms, a casing releasably secured to the working face side of said winch casing for receiving said piston and cylinder assemblies, and extensions from said drum drive motors to couple said piston and cylinder assemblies with said drum cutter support arms.

4. The drum cutter-loader machine according to claim 1 further including driving wheels each driven by one of said winch drive motors, a toothed rack extending below said transmission box along said face conveyor for engagement by said driving wheels intermediate wheels mounted within said transmission box for rotating said driving wheels, and reduction gearing mounted within said winch casing, said reduction gearing including output shafts coupled to said inermediate wheels.

5. The drum cutter-loader machine according to claim 4 wherein said toothed rack defines part of said machine track.

6. The drum cutter-loader machine according to claim 4 or 5 further including means to rotatably mount each of said rollers coaxially with one of said driving wheels to rotate independently thereof.

7. The drum cutter-loader machine according to claim 1 further including a toothed rack between said face conveyor and said machine track for propelling movement by said winch drive motors along the mine face, said machine track extending between the mine face and said toothed rack.

8. The drum cutter-loader machine according to claim 1 further including plates each having an extension releasably secured to one of opposite end faces of said winch casing, said extension supporting said pivot to mount each of said drum cutter support arms.

9. The drum cutter-loader machine according to claim 1 wherein said winch casing includes a longitudinally central cylindrical bore extending vertically, said drum cutter-loader machine further including a piston received in said cylindrical bore for movement into engagement with the mine floor for support of said winch casing.

10. The drum cutter-loader machine according to claim 1 further including actuating means including control elements housed by said gantry casing for controlling said cutter drum on each support arm.

11. The drum cutter-loader machine according to claim 1 wherein said gantry casing includes an opening to slidably receive said pivot to mount each of said drum cutter support arms.

12. The drum cutter-loader machine according to claim 1 further including piston and cylinder assemblies for pivotally positioning said drum cutter support arms, an actuator casing at the working face side of said winch casing for receiving said piston and cylinder assemblies, and tie bolts extending transversely to said face conveyor to join together said transmission box, said winch casing, said gantry casing and said actuator casing.

13. The drum cutter-loader machine according to claim 1 further including vertical piston and cylinder actuator assemblies carried by said gantry casing, guide runners extending around said guide bar for engagement by said vertical piston and cylinder actuator assemblies.

14. The drum cutter-loader machine according to claim 1 further including a toothed rack extending below said transmission box along said face conveyor and driving wheels each driven by one of said winch drive motors, said drive wheels each having curved teeth to mesh with said toothed rack with a lateral clearance sufficient for adjustments of the drum cutter-loader machine relative to said face conveyor.

15. The drum cutter-loader machine according to claim 1 wherein said rollers include a spherical peripheral surface to engage said machine track.

* * * * *